US009524681B2

(12) United States Patent
Vasquez et al.

(10) Patent No.: US 9,524,681 B2
(45) Date of Patent: Dec. 20, 2016

(54) BACKLIGHT MODULATION OVER EXTERNAL DISPLAY INTERFACES TO SAVE POWER

(75) Inventors: Maximino Vasquez, Fremont, CA (US); Paul Winer, Santa Clara, CA (US); Akihiro Takagi, San Mateo, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 13/996,935

(22) PCT Filed: Dec. 19, 2011

(86) PCT No.: PCT/US2011/065742

§ 371 (c)(1),
(2), (4) Date: Jun. 16, 2014

(87) PCT Pub. No.: WO2013/095324

PCT Pub. Date: Jun. 27, 2013

(65) Prior Publication Data

US 2014/0292631 A1 Oct. 2, 2014

(51) Int. Cl.
*G09G 3/34* (2006.01)
*G09G 3/20* (2006.01)

(52) U.S. Cl.
CPC ..... *G09G 3/3406* (2013.01); *G09G 3/2096* (2013.01); *G09G 2320/064* (2013.01);
(Continued)

(58) Field of Classification Search
CPC ..... G09G 3/2096; G09G 3/34; G09G 3/3426; G09G 2310/0237; G09G 2320/0233; G09G 2320/0626–2320/0653; G09G 2330/023; G09G 2360/16; G09G 2370/12; G09G 2370/047; G09G 2354/00
(Continued)

(56) References Cited

U.S. PATENT DOCUMENTS 4,695,883 A * 9/1987 Chandler ..... H04N 19/503 348/14.15
7,119,786 B2 10/2006 Cui
(Continued)

FOREIGN PATENT DOCUMENTS

JP 2006-308632 A 11/2006
WO 2013/095324 A1 6/2013

OTHER PUBLICATIONS

International Preliminary Report on Patentability and Written Opinion received for PCT Patent Application No. PCT/US2011/065742, mailed on Jul. 3, 2014, 9 pages.
(Continued)

*Primary Examiner* — Stephen Sherman
(74) *Attorney, Agent, or Firm* — Douglas J. Ryder; Ryder, Lu, Mazzeo & Konieczny LLC

(57) ABSTRACT

In general, in one aspect, an apparatus receives pixels associated with an image destined for an external display and determines a reduced backlight brightness for the external display and corresponding changes to the pixels to approximate overall quality of the image with current backlight brightness. Backlight commands are generated for the reduced backlight brightness and the pixels are enhanced to correspond to the reduced backlight brightness. The enhanced pixels and the backlight commands are transmitted to the external display via a display interface that supports backlight control. The display interface may be a wireless interface or a wired (cabled) interface (e.g., display port (DP), high definition multimedia interface (HDMI), video graphics array (VGA)). The functionality of the apparatus is included in a computing device so that backlight brightness reductions and corresponding pixel changes can be made taking into account policies of the computing device and user preferences.

21 Claims, 7 Drawing Sheets

(52) U.S. Cl.
CPC ..... *G09G 2320/0646* (2013.01); *G09G 2330/023* (2013.01); *G09G 2354/00* (2013.01); *G09G 2360/16* (2013.01); *G09G 2370/047* (2013.01); *G09G 2370/12* (2013.01)

(58) Field of Classification Search
USPC ..... 345/102
See application file for complete search history.

(56) References Cited

U.S. PATENT DOCUMENTS

| | | | | |
|---|---|---|---|---|
| 7,259,769 | B2 | 8/2007 | Difenbaugh et al. | |
| 7,348,957 | B2 | 3/2008 | Cui et al. | |
| 7,382,364 | B2 * | 6/2008 | Sasaki | 345/211 |
| 7,742,032 | B2 | 6/2010 | Difenbaugh et al. | |
| 8,847,998 | B2 * | 9/2014 | Maciesowicz et al. | 345/690 |
| 2004/0155854 | A1 * | 8/2004 | Ma | G06F 1/3203 345/102 |
| 2005/0057484 | A1 | 3/2005 | Difenbaugh et al. | |
| 2006/0001641 | A1 | 1/2006 | Degwekar et al. | |
| 2006/0092182 | A1 | 5/2006 | Difenbaugh et al. | |
| 2007/0035707 | A1 | 2/2007 | Margulis | |
| 2007/0216636 | A1 * | 9/2007 | Lo | G09G 3/3406 345/102 |
| 2008/0129679 | A1 | 6/2008 | Yamamoto | |
| 2008/0205519 | A1 | 8/2008 | Goodart et al. | |
| 2009/0189537 | A1 | 7/2009 | Hong | |
| 2010/0079364 | A1 * | 4/2010 | Feng | 345/102 |

OTHER PUBLICATIONS

International Search Report and Written Opinion received for PCT Patent Application No. PCT/US2011/065742, mailed on Sep. 14, 2012, 12 pages.

English Translation of Search Report for counterpart TW (ROC) application 101148058 dated Jun. 21, 2016.

* cited by examiner

BACKLIGHT MODULATION OVER EXTERNAL DISPLAY INTERFACES TO SAVE POWER

BACKGROUND

External displays are utilized to present content from various computing systems. The display is connected to the computing system with an appropriate interface, such as display port (DP), high definition multimedia interface (HDMI) or video graphics array (VGA). The content to be displayed may be the output of one or more applications running on the computing system, video stored on or received by the computing system, or other forms of media. The computing system may perform any necessary processing on the content in order to present the content on the display.

The display may be a liquid crystal display (LCD). The display typically includes an optical stack, panel electronics, and a backlight. The optical stack is where the content will be presented. The panel electronics receive instructions from the computing system (e.g., a graphics processor, a central processor) regarding the content to be presented and controls the writing of the content on the optical stack and may control the timing associated therewith. The backlight illuminates the optical stack so that the images written thereon can be seen by the user.

The display may include a backlight driver to control the operation of the backlight. In some displays the backlight is on all the time. In other displays, the backlight driver turns the backlight off when the panel electronics are generating an image on the optical stack (image refresh) to mitigate motion artifacts and/or conserve power. When the backlight is on, the brightness of the backlight is typically constant regardless of the content being presented. The backlight is a major source of power consumption in displays where the backlight is always on as well as those where it is throttled off during image refresh.

BRIEF DESCRIPTION OF THE DRAWINGS

The features and advantages of the various embodiments will become apparent from the following detailed description in which.

DETAILED DESCRIPTION

Figure 1:
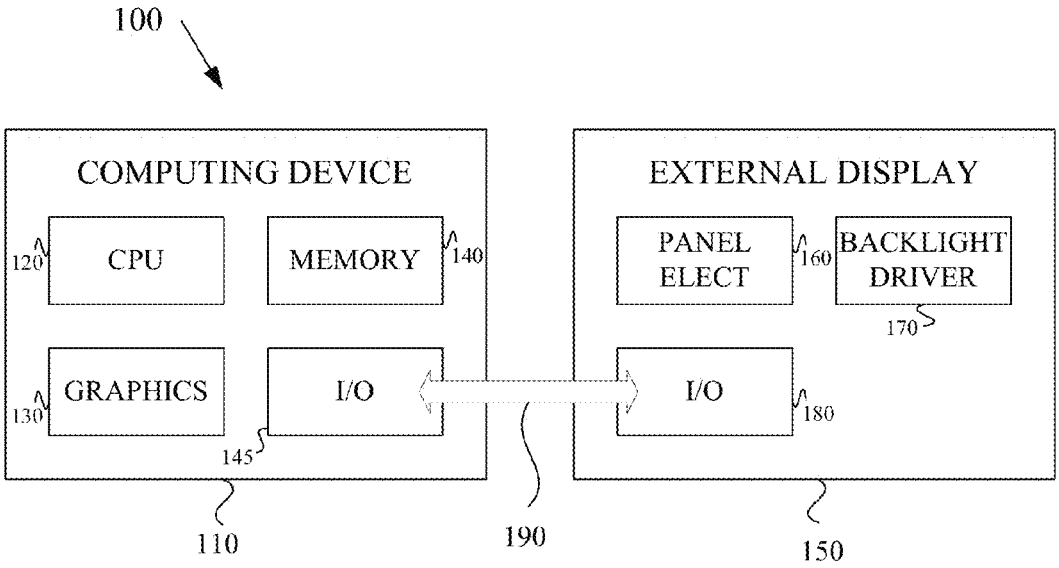
FIG. 1 illustrates a high level block diagram of a system including a computing device and an external display.

FIG. 1 illustrates a high level block diagram of a system 100 including a computing device 110 and an external display 150. The computing device 110 may include a main processor (CPU) 120, a graphics processor 130, memory 140 and input/output interface (I/O) 145. The I/O 145 may include one or more connectors and associated interfaces for connecting to and interfacing with the external display 150. The external display 150 may include panel electronics 160, a backlight driver 170, and I/O 180. The I/O 180 may include one or more connectors and associated interfaces for connecting to and interfacing with the computing device 110. A display interface 190 may be utilized to connect the computing device 110 and the external display 150 via the I/O's 145, 180. The display interface 190 may be a wireless or wired (cabled) interface. A wired interface may include an interface cable. The wired interface may be, for example, a display port (DP), high definition multimedia interface (HDMI) or video graphics array (VGA) interface. The display interface 190 may provide bidirectional communications.

The CPU 120 or graphics processor 130 of the computing device 110 may process data related to content (e.g., a video) to be presented on the external display 150. The processed data related to the content may be stored in the memory 140. The memory 140 may include a frame buffer (not separately illustrated) for storing the processed data to be displayed. The processed data from the frame buffer may be transmitted to the display via the I/O 145, the display interface 190, and the I/O 180. The panel electronics 160 may generate images on the optical stack (not illustrated) of the display 150 based on the processed data. The backlight driver 170 may control operation of the backlight (not illustrated) which illuminates the optical stack so that the user can see the images generated on the display 150.

Figure 2:
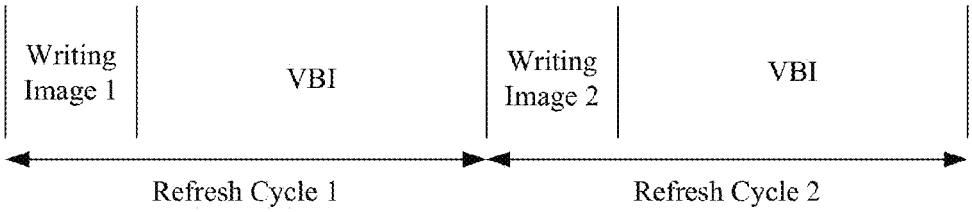
FIG. 2 illustrates an example timing diagram of high level operations of an external display.

FIG. 2 illustrates an example timing diagram of operations of an external display. The timing diagram includes two refresh cycles of the display, where the refresh cycle is how often a new image is generated for the display (e.g., 60 Hz, 120 Hz). Each refresh cycle includes time for the image to be written on the optical stack pixel by pixel (image refresh) followed by a delay, vertical blanking interval (VBI), before the next image is written over the current image. The panel electronics are active when the image is being written and inactive, but not necessarily powered down, during the VBI. The timing associated with the image refresh occurs at a rate that is fast enough that the human eye does not detect the pixel by pixel changes (pixel clock). The portion of the refresh cycle that is associated with the image refresh is based on the resolution of the display (e.g., 640×480 pixels, 1024×768 pixels) and the pixel clock (e.g., 10 MHz).

The backlight for some displays may be on all the time, while the backlight for other displays may be turned off when the panel electronics are writing the image to the optical stack (image refresh). The backlight may be turned off during image refresh to mitigate motion artifacts and/or to conserve energy. For displays turning the backlight off during image refresh, the panel electronics and the backlight driver may communicate in some fashion so that the backlight driver is aware when image refresh is occurring. The image generated on the optical stack is visible during the VBI when the backlight is illuminated and the optical stack is not being written to.

The backlight need not simply be turned on or off. Rather, the backlight may be capable of providing light over a brightness spectrum. The brightness may be controlled by pulsing the backlight on and off at a fast rate, pulse width modulation (PWM). The pulsing on/off of the backlight can not be detected by the human eye.

The higher percentage of time the backlight is off for a defined cycle (lower PWM frequency), the dimmer the backlight illumination is. The brightness of the backlight may also be controlled by the voltage level applied thereto. The lower the voltage level applied to the backlight, the dimmer the backlight illumination is. A combination of PWM and voltage level may be utilized to control the brightness of the backlight.

Figure 3:
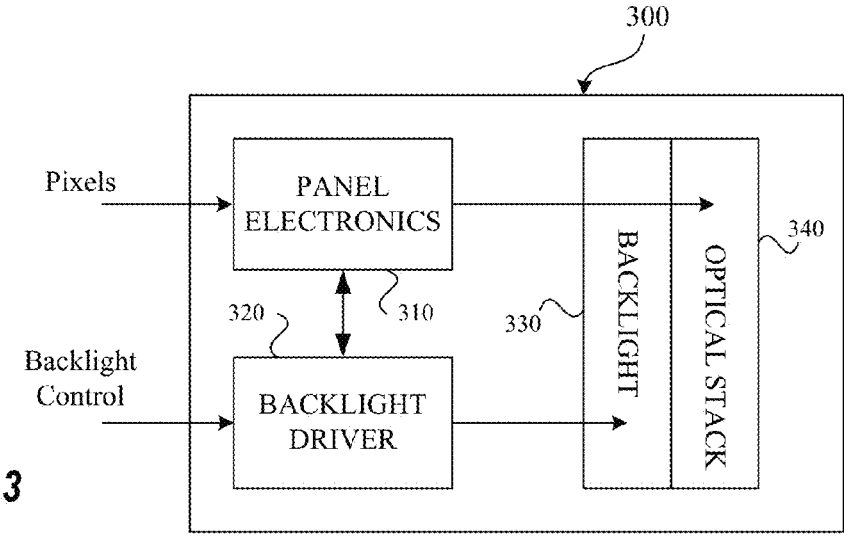
FIG. 3 illustrates a functional block diagram of an example external display capable of modifying the backlight illumination, according to one embodiment.

FIG. 3 illustrates a functional block diagram of an example external display 300 capable of modifying the backlight illumination. The display 300 includes panel electronics 310, backlight driver 320, backlight 330, and optical stack 340. The panel electronics 310 receives pixel data for an image (frame) from a platform and uses the pixel data to write the image on the optical stack 340. The backlight driver 320 controls the operation of the backlight 330. The backlight driver 320 and the panel electronics 310 may communicate therebetween in some fashion. This communication is used, for example, in displays in which the backlight 330 is off during image writing.

The brightness of the backlight 330 may be controlled by setting parameters (e.g., brightness) for the display 300 via a user interface for the display 300. The backlight driver 320 may receive the parameter settings and provide the appropriate controls to the backlight 330 based thereon. Typically, the brightness of the backlight 330 is constant based on the parameter settings. Power savings could be achieved by adjusting the backlight brightness (e.g., adjusting PWM, voltage level, or some combination of both) based on content being presented. The backlight driver 320 may receive commands regarding adjusting the backlight level (e.g., dimming to save power) based on the content and provide the appropriate controls to the backlight 330 based thereon.

Figure 4:
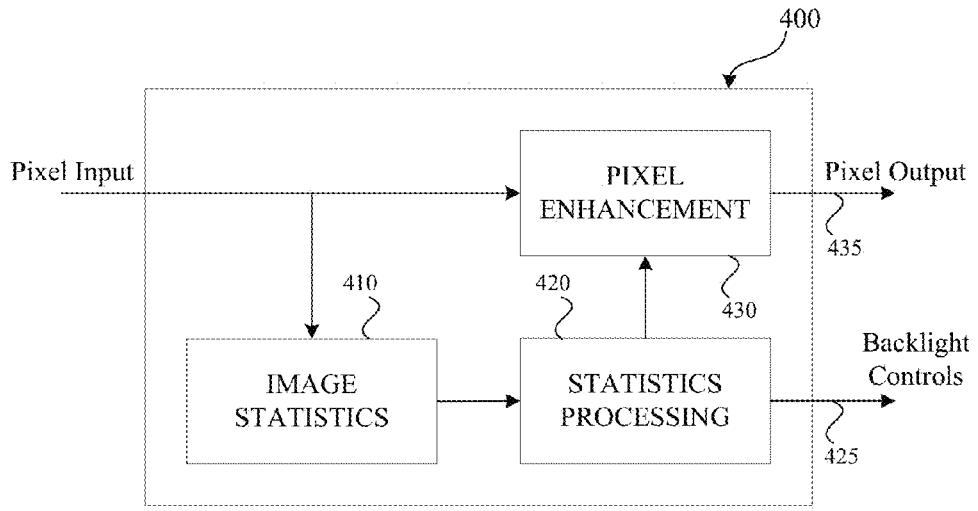
FIG. 4 illustrates a block diagram of an example display power savings functionality, according to one embodiment.

FIG. 4 illustrates a block diagram of an example display power savings functionality 400. The functionality 400 may include image statistics 410, statistics processing 420, and pixel enhancement/modification 430. The image data (e.g., pixels) destined for the display is received by the image statistics function 410 that calculates and collects statistics related to the image being presented. The statistics may include color, contrast and brightness of the image to be presented based on the pixels provided and the current backlight brightness (e.g., default, based on display settings). The statistics may also monitor changes in the images being presented.

The statistics are provided to the statistics processing function 420 to determine if and how much the backlight brightness can be reduced with corresponding changes to the pixels to maintain or approximate the overall quality (color, contrast, brightness) of the original image and the current backlight setting. That is, can the color, contrast and/or brightness of the pixels be modified so that for less backlight brightness the overall image quality is substantially maintained. The statistics processing function 420 provides instructions related to pixel modifications to the pixel enhancement function 430. The pixel enhancement function 430 modifies the identified pixels of the image as instructed and outputs the modified pixels 435 to the display. The statistics processing function 420 also provides instructions related to backlight modification 425 to the display.

Figure 5A:
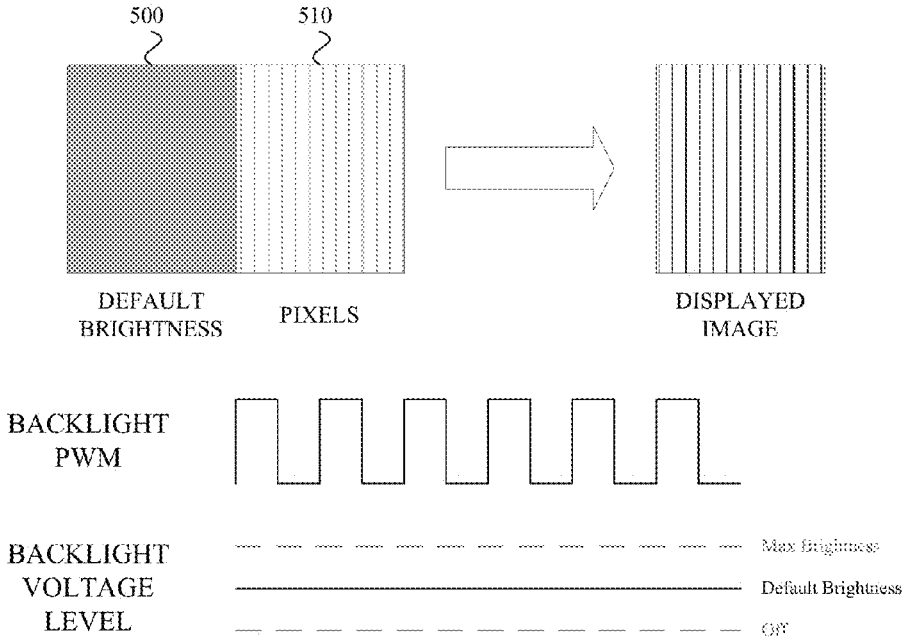
FIGS. 5A-B illustrate an example modification of the backlight brightness and associated changes to the pixels to display an image that looks substantially the same, according to one embodiment.
Figure 5B:
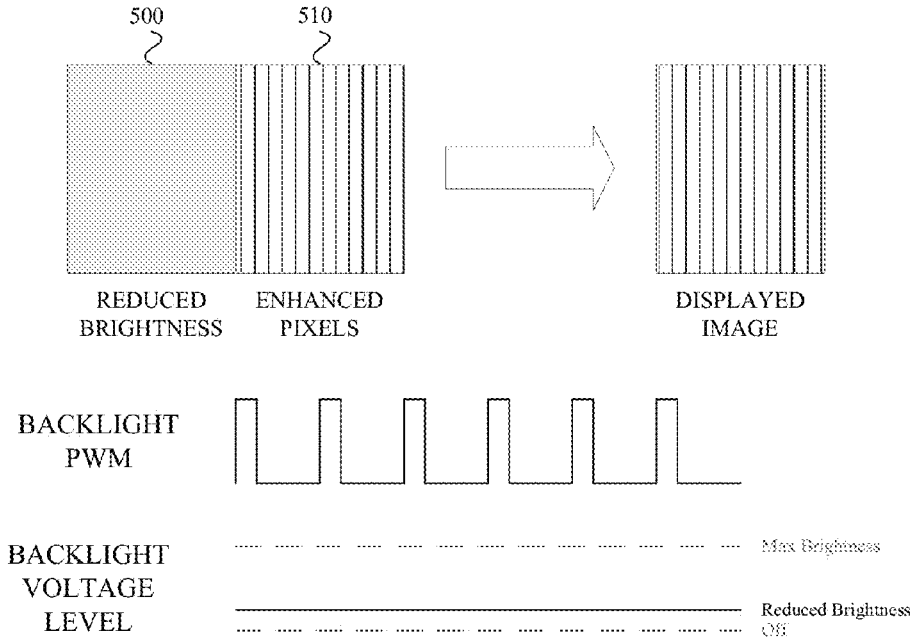

FIGS. 5A-B illustrate an example modification of the backlight brightness and associated changes to the pixels to display an image that looks substantially the same. FIG. 5A illustrates the backlight 500 being illuminated the default brightness for the display, the pixels written on the optical stack 510 by the panel electronics based on the default backlight brightness, and the resultant image presented. Two different methods of obtaining the default brightness are illustrated (PWM and voltage level). The PWM of the backlight to provide the default brightness is illustrated as the backlight being on approximately 50% of the time. Likewise, the voltage level of the backlight to provide the default brightness is illustrated as being approximately 50% of the voltage level required to provide maximum brightness.

FIG. 5B illustrates the brightness of the backlight 500 being reduced, the enhanced pixels written on the optical stack 510 by the panel electronics based on the reduced backlight brightness, and the resultant image presented being substantially the same. Both the PWM and voltage level methods of obtaining the reduced brightness are illustrated. The PWM of the backlight to provide the reduced brightness is illustrated as the backlight being on approximately 25% of the time. Likewise, the voltage level of the backlight to provide the reduced brightness is illustrated as being approximately 25% of the voltage level required to provide maximum brightness.

Figure 6A:
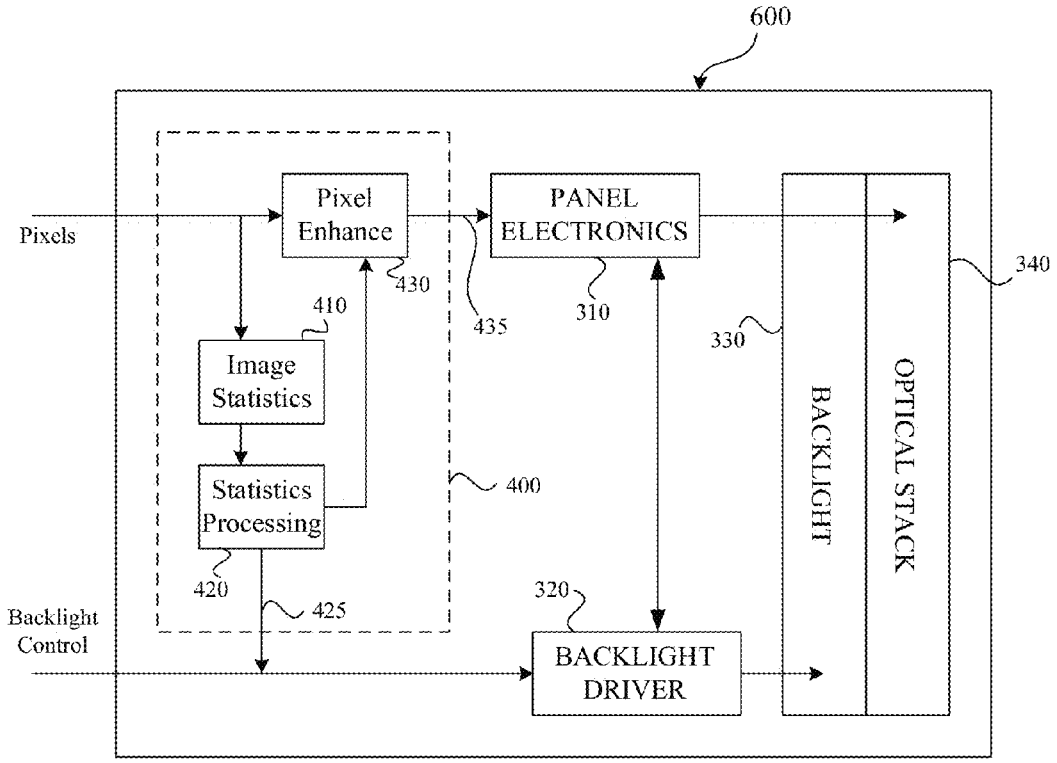
FIG. 6A illustrates an example display utilizing display power savings functionality, according to one embodiment.

FIG. 6A illustrates an example display 600 utilizing display power savings functionality. The display 600 includes the panel electronics 310, the backlight driver 320, the backlight 330, the optical stack 340 and the display power savings functionality 400. The functionality 400 may include the image statistics 410, the statistics processing 420, and the pixel enhancement/modification 430. The pixels received from a computing system platform are provided to the display power savings functionality 400 where a determination is made with regard to if and how much the backlight brightness can be reduced with corresponding changes to the pixels to maintain or approximate the overall quality (color, contrast, brightness) of the original image and the current backlight setting. Pixel enhancements 435 are provided to the panel electronics 310 and backlight modifications 425 are provided to the backlight driver 320.

Implementing display power savings functionality in an external display increases the complexity and cost thereof. Furthermore, the modifications to backlight and/or pixels made by the external display are made without any consideration for system and/or user preferences that may be made if implemented at the system level.

Figure 6B:
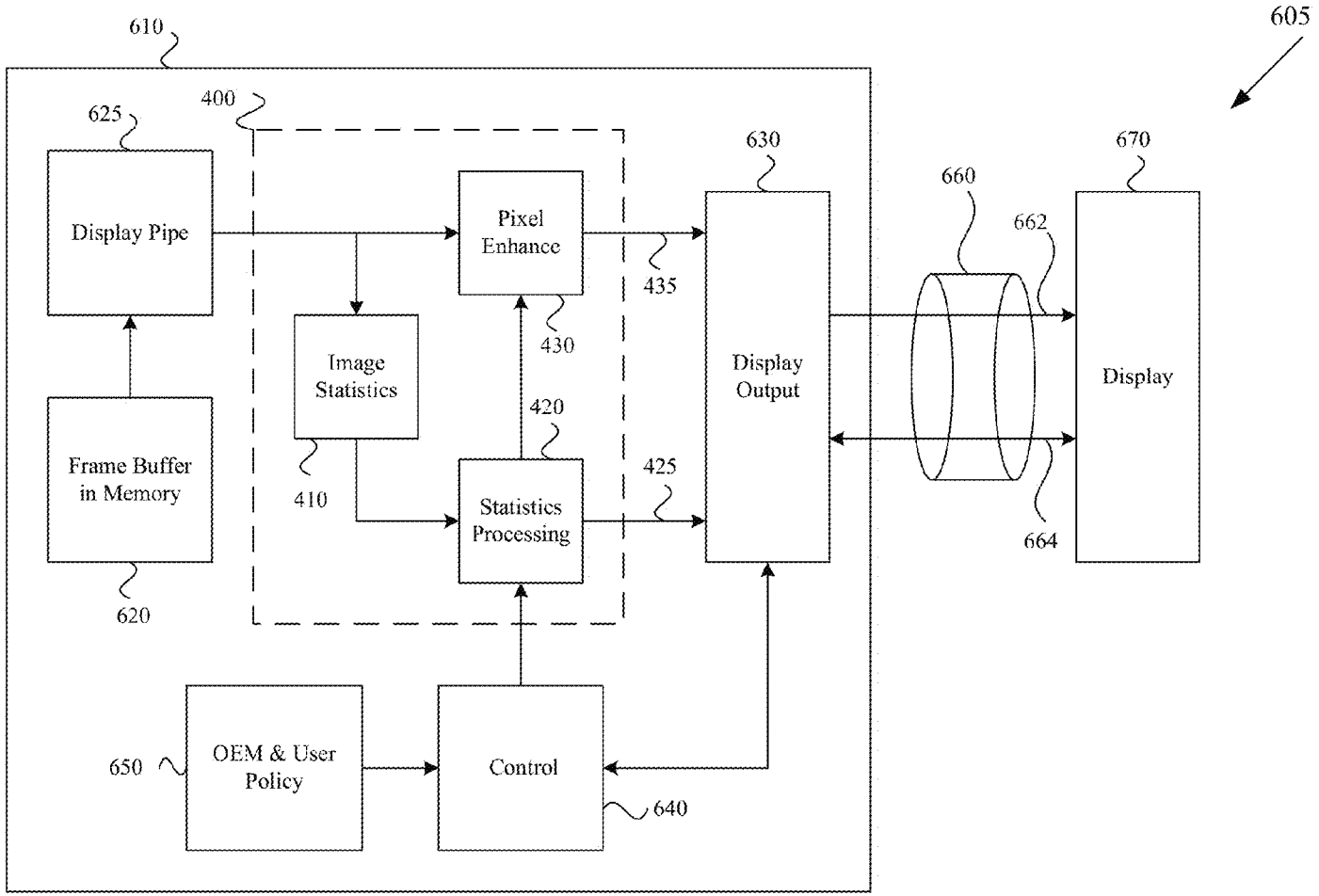
FIG. 6B illustrates an example system utilizing display power savings functionality, according to one embodiment.

FIG. 6B illustrates an example system 605 utilizing display power savings functionality. The system 605 includes a computing device 610, an external display 670 and a display interface 660 coupled thereto and providing communications therebetween. The display power savings functionality 400 is contained within the computing device 610. The computing device 610 also includes memory that has a frame buffer defined therein 620, a display pipeline 625, a display output 630, a controller 640 and a policy engine 650. The frame buffer 620 contains data (e.g., pixels) for the image to be presented on the external display 670. The image to be presented may, for example, have been generated by one or more programs running thereon or media (e.g., video) being played thereon or being received thereby.

As needed, the image data may be transported from the frame buffer 620 via the display pipe 630. If activated, the image data may be processed by the display power savings functionality 400. The enhanced pixels 435 and the backlight commands 425 are output from therefrom to the display output 630. The display output 630 may provide the interface processing and the connection for one or more display interfaces 660 supporting backlight control. The display interface 660 may be a wireless interface or a wired (e.g., cabled) interface. The wired interface may be, for example, a display port (DP), high definition multimedia interface (HDMI) or video graphics array (VGA) interface and may include an appropriate interface cable. The display interface 660 may include unidirectional data channels 662 and bidirectional control channels 664. The bidirectional control channels 664 in HDMI and VGA cables is provided by certain pins that act as display data channel (DDC). DP cables have an auxiliary channel, called the AUX channel, which is utilized as the bidirectional control channels 664.

The enhanced pixels 435 are transmitted to the external display 670 via the unidirectional channels 662 within the display interface 660. For HDMI and VGA interfaces the backlight commands 425 may be transmitted as monitor control command set (MCCS) commands over the DDC control lines 664. For DP interfaces the backlight commands 425 may be transmitted directly over the unidirectional data channels 662 as data packets or as MCCS commands or display port control data (DPCD) via the AUX channel 664. The display output 630 may configure the backlight commands 425 as data packets, DPCD or MCCS commands.

The computing system 610 may receive information about the external display 670 via the bidirectional control channels 664. The display information received may include display size, refresh rate, default backlight level and whether the backlight setting can be modified by external commands. The information may be provided to a controller 640. The controller 640 may utilize the display information to provide instructions/settings to a processor or a graphics function (not illustrated) in order to aid in the generation of the images to be presented on the display. The controller 640 may also utilize the display information to determine whether the display power savings functionality 400 should be active. If active, the controller 640 may provide operational instructions/settings to the display power savings functionality 400 (the statistics processing function 420). The instructions may be related to the default backlight brightness, the range of brightness that can be provided, how often the backlight may be modified and the like. The controller 640 may also receive computing device policies and user policies regarding image quality parameters for different content being presented and may generate and provide operational instructions/settings to the display power savings functionality 400 based thereon.

Figure 7:
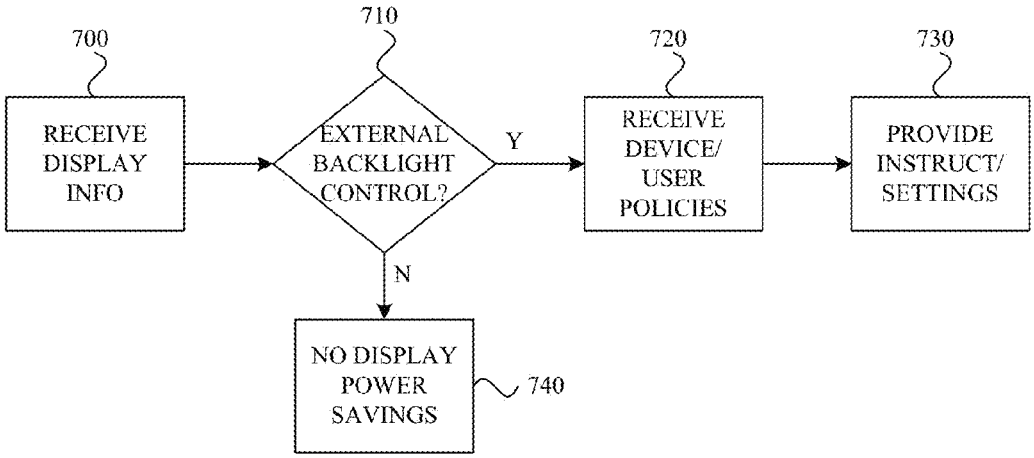
FIG. 7 illustrates an example high level flowchart regarding the configuration of the display power savings functionality, according to one embodiment.

FIG. 7 illustrates an example high level flowchart regarding the configuration of the display power savings functionality 400 (operation of the controller 640). Information about the external display connected to the computing device is received 700. Based on the display information, a determination is made as to whether the backlight of the display can be externally controlled by the computing device 710. If the determination is that the display backlight can not be controlled (710 No), then the display power functionality is not activated 740. If the determination is that the display backlight can be controlled (710 Yes), then computing device policies and/or user policies regarding the image quality parameters for different content being presented are received 720. The policies may define how much the image may be degraded for various different content being presented thereon (quality thresholds). For example, the policy may define that games being played on the device or movies being watched have a very high quality threshold while Internet searching or word processing may have a lower threshold. The lower the quality threshold the more aggressive the backlight modification and power savings can be. Based on the display information and the user/device policies, instructions and/or settings can be provided for the display power functionality.

Figure 8A:
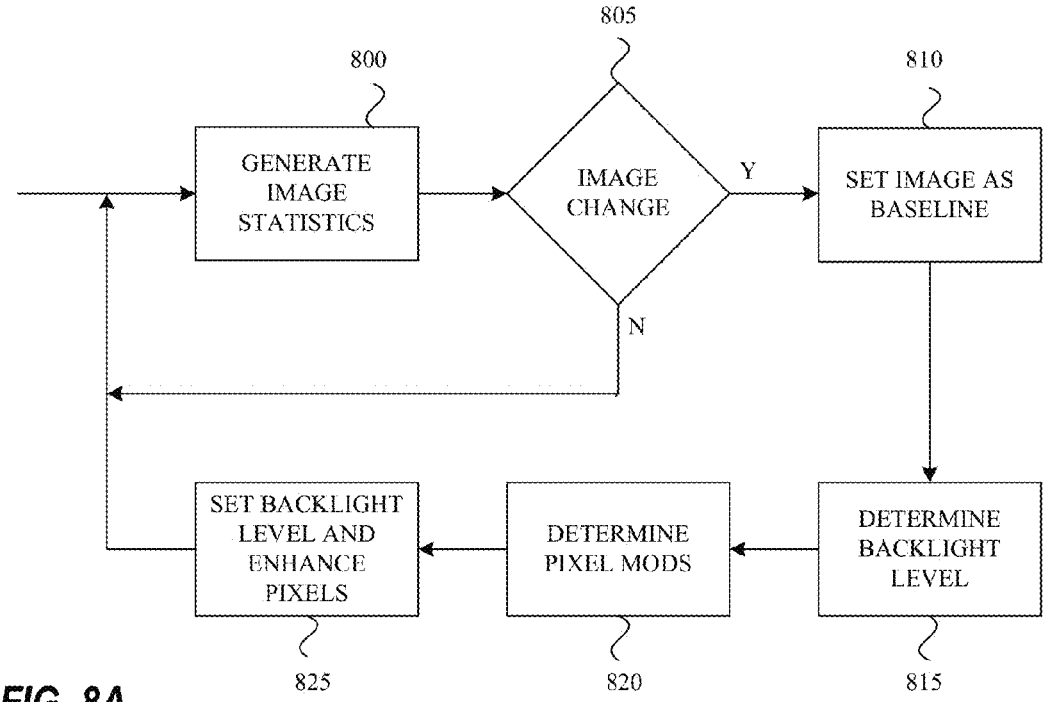
FIGS. 8A-B illustrate example high level flowcharts regarding the operation of the display power savings functionality, according to one embodiment.

FIG. 8A illustrates an example high level flowchart regarding the operation of the display power savings functionality 400. For each image (frame), image statistics may be captured and analyzed 800. A determination may be made as to whether the new image differs from a previous baseline image by some threshold 805. If the threshold is exceeded (805 Yes), statistics about the image being presented, or the image itself, may be captured as a new baseline image 810. A determination may be made regarding what the minimum backlight level that can be supported for the baseline image is 815. Once the backlight reduction is determined, modifications to the pixels may be determined so that the resultant image presented on the display operating at the reduced backlight level simulates the original image at the default backlight brightness 820. The backlight level is then set by sending instructions to the backlight driver and the pixel enhancements are made by providing instructions to the pixel enhancement block to set the pixel enhancement levels 825. The process starts again for next image received 800. If the threshold is not exceeded (805 No), then the baseline image is not changed, the backlight level and pixel modifications are not changed, and the process starts again for the next image received 800.

Substantially modifying the backlight brightness at one time may result in changes in the displayed image that a viewer may notice. The amount of backlight modification that may be noticed may vary based on display, content, user, system or the like. Accordingly, there may be a limit regarding how much the backlight brightness and the corresponding pixel enhancements can change at one time. According to one embodiment, if the backlight brightness modification exceeds some threshold the backlight modification and associated pixel enhancements may be made in incremental steps. According to one embodiment, all backlight modification and associated pixel enhancements are made in incremental steps.

Figure 8B:
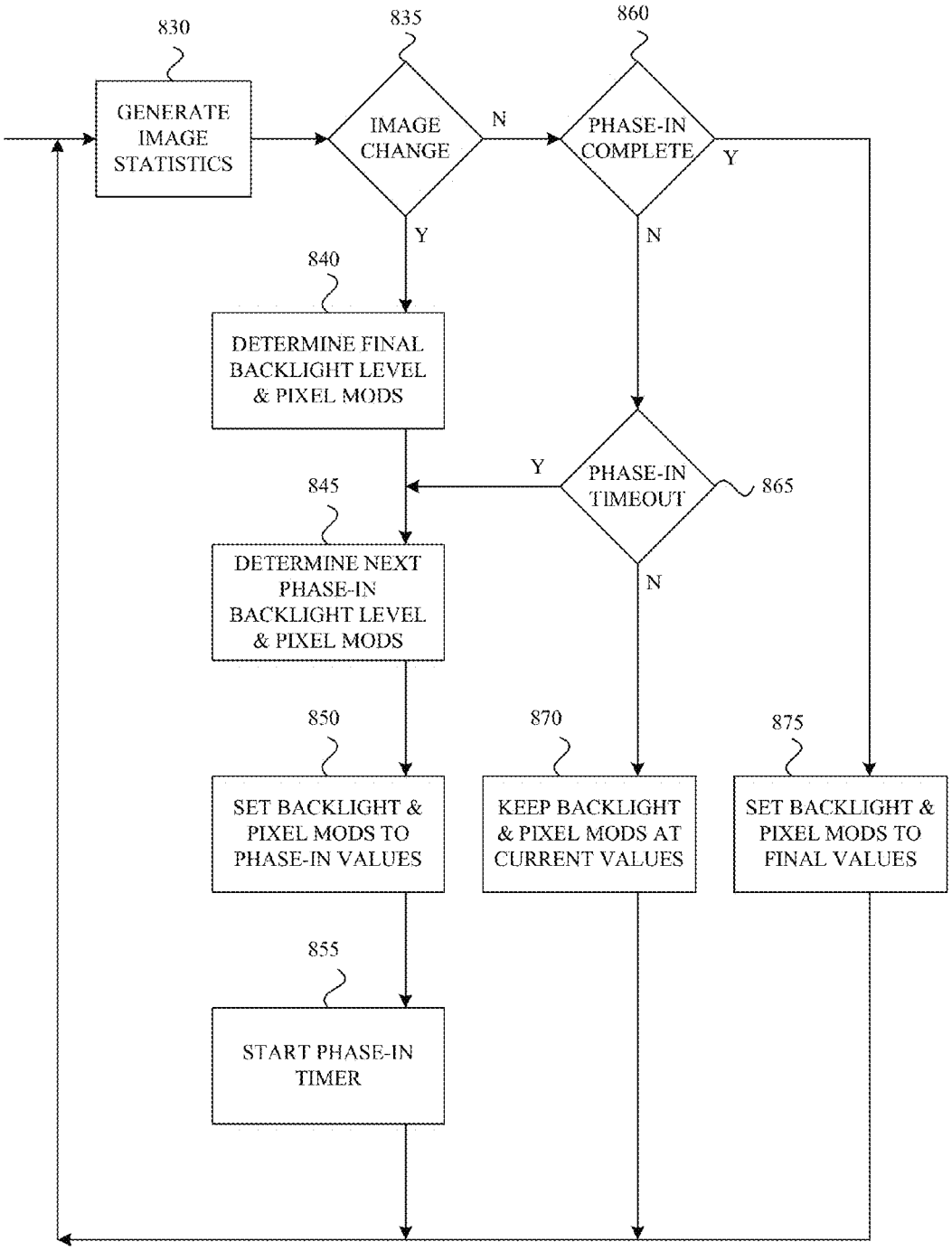

FIG. 8B illustrates an example high level flowchart regarding the operation of the display power savings functionality 400 with changes made in phases. For each image (frame), image statistics may be captured and analyzed 830. A determination may be made as to whether the new image differs from a previous baseline image by some threshold 835. If the threshold is exceeded (835 Yes), statistics about the image being presented, or the image itself, may be captured as a new baseline image. A determination may be made regarding what the final backlight level and corresponding pixel modifications are 840. A determination about a next phase-in of the backlight level and corresponding pixel modifications is made 845. The phase in backlight level and corresponding pixel modifications are set 850. A phase is timer is then started 855 and then the process starts again for a next frame 830.

If the threshold is not exceeded (835 No), a determination is made with regard to whether the phase-in is complete 860. If the phase-in is not complete (860 No), then a determination is made as to whether there has been a phase in time-out 865. If there was a phase-in time out (865 Yes), then a determination about a next phase-in of the backlight level and corresponding pixel modifications is made 845. If there was no phase-in time out (865 No), then the backlight and pixel modifications are kept at the current values 870 and then the process starts again for a next frame 830. If the phase-in is complete (860 Yes), then the backlight and pixel modifications are set to their final values 880 and then the process starts again for a next frame 830.

According to one embodiment, the display may be capable of separately controlling different sections of the backlight. For example, the sections may be columns (e.g., four 160×480 columns for a 640×480 display), rows (e.g., four 640×120 rows for a 640×480 display) or quadrants (e.g., upper left, upper right, lower left, lower right). The display may include a plurality of backlight drivers or the backlight driver may be capable of controlling various separately controllable backlight sections. The display power savings functionality 400 may gather statistics and analyze the statistics for sections of images associated with the separately controllable backlight sections. The analysis may determine that some sections have backlight modifications and pixel enhancements while others don't. The analysis may determine that different sections have different backlight modifications and corresponding pixel enhancements. For each image, the appropriate backlight and pixel modifications will be made for each section.

The display power savings functionality described in FIGS. 4-8B may be implemented, for example, in a CPU 120, a graphics processor 130, a display engine, a display pipeline 625, a display output 630, one or more discrete components or some combination thereof. Furthermore, the operations may be implemented in hardware, software, firmware or some combination thereof. The CPU 120, graphics processor 130, and/or display engine may have access to device readable storage (on the device, off the device, or some combination thereof) that contains instructions that when executed by the device causes the device to perform at least a subset of the operations described above in FIGS. 4-8B.

The various embodiments described above may be implemented in various systems that display content (content display systems) and the content display systems may be incorporated in various devices.

Figure 9:
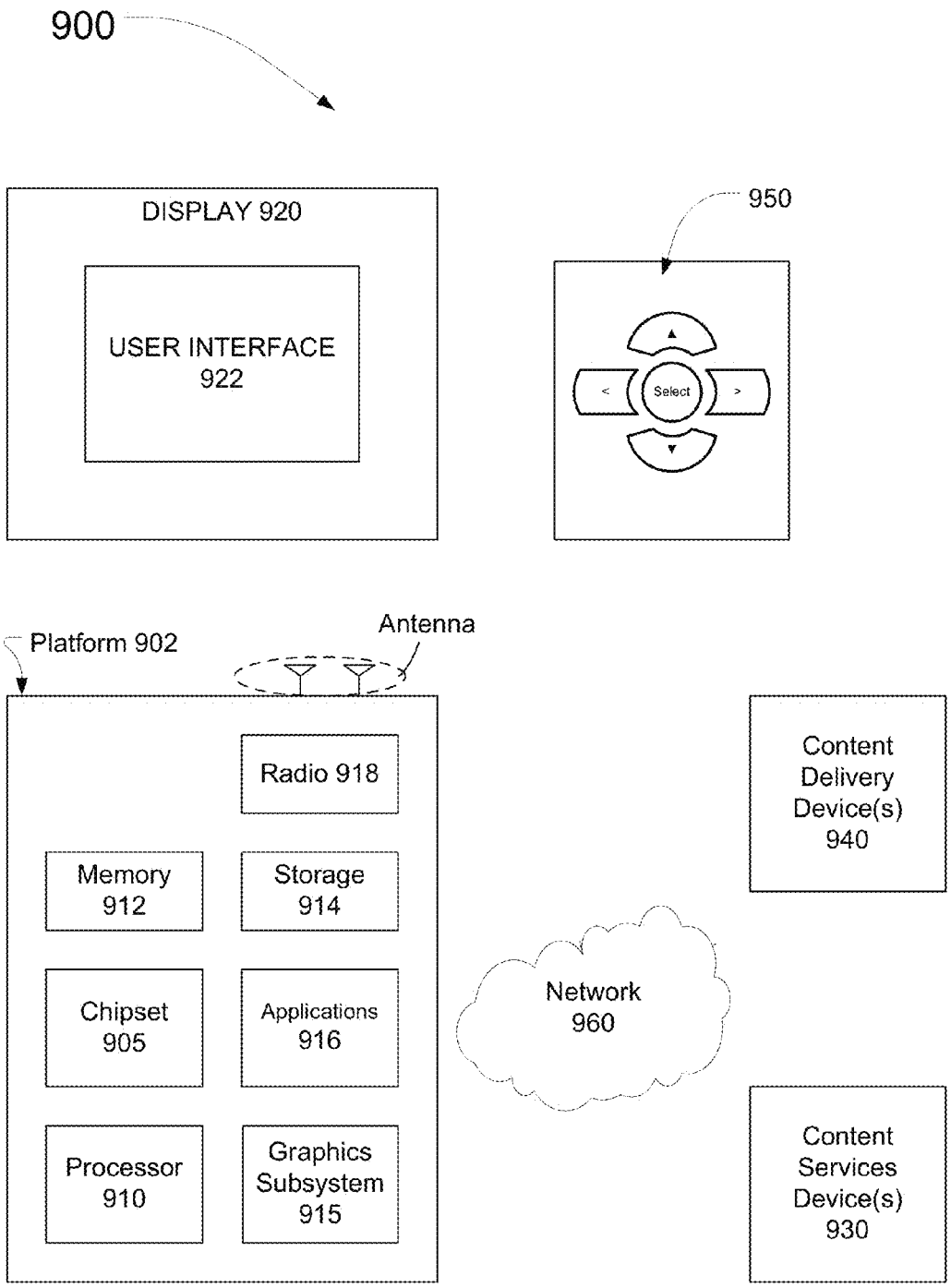
FIG. 9 illustrates an example content display system, according to one embodiment.

FIG. 9 illustrates an example content display system 900. The system 900 may be a media system although it is not limited to this context. The system 900 may be incorporated into, for example, a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, and so forth.

In embodiments, the system 900 comprises a platform 902 coupled to an external display 920. The platform 902 may receive content from a content device such as content services device(s) 930, content delivery device(s) 940 or other similar content sources. A navigation controller 950 comprising one or more navigation features may be used to interact with, for example, the platform 902 and/or the display 920.

In embodiments, the platform 902 may comprise any combination of a chipset 905, a processor 910, memory 912, storage 914, a graphics subsystem 915, applications 916 and/or a radio 918. The chipset 905 may provide intercommunication among the processor 910, the memory 912, the storage 914, the graphics subsystem 915, the applications 916 and/or the radio 918. The chipset 905 may, for example, include a storage adapter (not depicted) capable of providing intercommunication with the storage 914.

The processor 910 may be implemented as Complex Instruction Set Computer (CISC) or Reduced Instruction Set Computer (RISC) processors, x86 instruction set compatible processors, multi-core, or any other microprocessor or central processing unit (CPU). In embodiments, the processor 910 may comprise dual-core processor(s), dual-core mobile processor(s), and so forth.

The memory 912 may be implemented as a volatile memory device such as, but not limited to, a Random Access Memory (RAM), Dynamic Random Access Memory (DRAM), or Static RAM (SRAM).

The storage 914 may be implemented as a non-volatile storage device such as, but not limited to, a magnetic disk drive, optical disk drive, tape drive, an internal storage device, an attached storage device, flash memory, battery backed-up SDRAM (synchronous DRAM), and/or a network accessible storage device. In embodiments, the storage 914 may comprise technology to increase the storage performance and/or enhance protection for valuable digital media when multiple hard drives are included, for example.

The graphics subsystem 915 may perform processing of images such as still or video for display. The graphics subsystem 915 may be a graphics processing unit (GPU) or a visual processing unit (VPU), for example. An analog or digital interface may be used to communicatively couple the graphics subsystem 915 and the display 920. For example, the interface may be any of a High-Definition Multimedia Interface, DisplayPort, wireless HDMI, and/or wireless HD compliant techniques. The graphics subsystem 915 could be integrated into the processor 910 or the chipset 905. The graphics subsystem 915 could be a stand-alone card communicatively coupled to the chipset 905.

The graphics and/or video processing techniques described herein may be implemented in various hardware architectures. For example, graphics and/or video functionality may be integrated within a chipset. Alternatively, a discrete graphics and/or video processor may be used. As still another embodiment, the graphics and/or video functions may be implemented by a general purpose processor, including a multi-core processor. In a further embodiment, the functions may be implemented in a consumer electronics device.

The radio 918 may include one or more radios capable of transmitting and receiving signals using various suitable wireless communications techniques. Such techniques may involve communications across one or more wireless networks. Exemplary wireless networks include (but are not limited to) wireless local area networks (WLANs), wireless personal area networks (WPANs), wireless metropolitan area network (WMANs), cellular networks, and satellite networks. In communicating across such networks, the radio 918 may operate in accordance with one or more applicable standards in any version.

In embodiments, the display 920 may comprise any television type monitor or display. The display 920 may comprise, for example, a computer display screen, touch screen display, video monitor, television-like device, and/or a television. The display 920 may be digital and/or analog. In embodiments, the display 920 may be a holographic display. Also, the display 920 may be a transparent surface that may receive a visual projection. Such projections may convey various forms of information, images, and/or objects. For example, such projections may be a visual overlay for a mobile augmented reality (MAR) application. Under the control of one or more software applications 916, the platform 902 may display the user interface 922 on the display 920.

In embodiments, the content services device(s) 930 may be hosted by any national, international and/or independent service and thus accessible to the platform 902 via the Internet, for example. The content services device(s) 930 may be coupled to the platform 902 and/or to the display 920. The platform 902 and/or the content services device(s) 930 may be coupled to a network 960 to communicate (e.g., send and/or receive) media information to and from the network 960. The content delivery device(s) 940 also may be coupled to the platform 902 and/or to the display 920.

In embodiments, the content services device(s) 930 may comprise a cable television box, personal computer, network, telephone, Internet enabled devices or appliance capable of delivering digital information and/or content, and any other similar device capable of unidirectionally or bidirectionally communicating content between content providers and the platform 902 and/or the display 920, via the network 960 or directly. It will be appreciated that the content may be communicated unidirectionally and/or bidirectionally to and from any one of the components in the system 900 and a content provider via the network 960. Examples of content may include any media information including, for example, video, music, medical, gaming information, and so forth.

The content services device(s) 930 receives content such as cable television programming including media information, digital information, and/or other content. Examples of content providers may include any cable or satellite television or radio or Internet content providers. The provided examples are not meant to limit embodiments of the invention.

In embodiments, the platform 902 may receive control signals from navigation controller 950 having one or more navigation features. The navigation features of the controller 950 may be used to interact with the user interface 922, for example. In embodiments, the navigation controller 950 may be a pointing device that may be a computer hardware component (specifically human interface device) that allows a user to input spatial (e.g., continuous and multi-dimensional) data into a computer. Many systems such as graphical user interfaces (GUI), televisions and monitors allow the user to control and provide data to the computer or television using physical gestures.

Movements of the navigation features of the controller 950 may be echoed on a display (e.g., display 920) by movements of a pointer, cursor, focus ring, or other visual indicators displayed on the display. For example, under the control of software applications 916, the navigation features located on the navigation controller 950 may be mapped to virtual navigation features displayed on the user interface 922, for example. In embodiments, the controller 950 may not be a separate component but integrated into the platform 902 and/or the display 920. Embodiments, however, are not limited to the elements or in the context shown or described herein.

In embodiments, drivers (not shown) may comprise technology to enable users to instantly turn on and off the platform 902 like a television with the touch of a button after initial boot-up, when enabled, for example. Program logic may allow the platform 902 to stream content to media adaptors or other content services device(s) 930 or content delivery device(s) 940 when the platform is turned "off" In addition, the chipset 905 may comprise hardware and/or software support for 5.1 surround sound audio and/or high definition 7.1 surround sound audio, for example. Drivers may include a graphics driver for integrated graphics platforms. In embodiments, the graphics driver may comprise a peripheral component interconnect (PCI) Express graphics card.

In various embodiments, any one or more of the components shown in the system 900 may be integrated. For example, the platform 902 and the content services device(s) 930 may be integrated, or the platform 902 and the content delivery device(s) 940 may be integrated, or the platform 902, the content services device(s) 930, and the content delivery device(s) 940 may be integrated, for example. In various embodiments, the display 920 and the content service device(s) 930 may be integrated, or the display 920 and the content delivery device(s) 940 may be integrated, for example. These examples are not meant to limit the invention.

In various embodiments, the system 900 may be implemented as a wireless system, a wired system, or a combination of both. When implemented as a wireless system, the system 900 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the RF spectrum and so forth. When implemented as a wired system, the system 900 may include components and interfaces suitable for communicating over wired communications media, such as input/output (I/O) adapters, physical connectors to connect the I/O adapter with a corresponding wired communications medium, a network interface card (MC), disc controller, video controller, audio controller, and so forth. Examples of wired communications media may include a wire, cable, metal leads, printed circuit board (PCB), backplane, switch fabric, semiconductor material, twisted-pair wire, co-axial cable, fiber optics, and so forth.

The platform 902 may establish one or more logical or physical channels to communicate information. The information may include media information and control information. Media information may refer to any data representing content meant for a user. Examples of content may include, for example, data from a voice conversation, videoconference, streaming video, electronic mail ("email") message, voice mail message, alphanumeric symbols, graphics, image, video, text and so forth. Data from a voice conversation may be, for example, speech information, silence periods, background noise, comfort noise, tones and so forth. Control information may refer to any data representing commands, instructions or control words meant for an automated system. For example, control information may be used to route media information through a system, or instruct a node to process the media information in a predetermined manner. The embodiments, however, are not limited to the elements or in the context shown or described in FIG. 9.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chipsets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

One or more aspects of at least one embodiment may be implemented by representative instructions stored on a machine-readable medium which represents various logic within the processor, which when read by a machine causes the machine to fabricate logic to perform the techniques described herein. Such representations, known as "IP cores" may be stored on a tangible, machine readable medium and supplied to various customers or manufacturing facilities to load into the fabrication machines that actually make the logic or processor.

Although the disclosure has been illustrated by reference to specific embodiments, it will be apparent that the disclosure is not limited thereto as various changes and modifications may be made thereto without departing from the scope. Reference to "one embodiment" or "an embodiment" means that a particular feature, structure or characteristic described therein is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

What is claimed:

1. An apparatus comprising an image statistics collector to receive pixels associated with an image destined for an external display; and calculate and collect statistics related to the pixels and the image including overall quality of the image to be presented on the external display with a current backlight brightness of the external display;

a statistics processor to determine an amount the current backlight brightness of the external display can be reduced such that corresponding changes to the pixels can be made to approximate the overall quality of the image presented on the external display with the current backlight brightness of the external display; and generate the backlight commands to instruct a backlight driver of the external display to provide a reduced backlight brightness that corresponds to reducing the current backlight brightness of the external display by the determined amount;

a pixel enhancer to enhance the pixels with the corresponding changes; and a display interface to transmit the enhanced pixels and the backlight commands to the external display.

2. The apparatus of claim 1, wherein the statistics processor is to generate the backlight commands as data packets; and the display interface is to transmit the data packets of the backlight commands over unidirectional data channels used to transmit pixels.

3. The apparatus of claim 1, wherein the display interface is to transmit the backlight commands via a bidirectional control channel.

4. The apparatus of claim 3, wherein the statistics processor is to generate the backlight commands as monitor control command set (MCCS) commands.

5. The apparatus of claim 3, wherein the statistics processor is to generate the backlight commands as display port control data (DPCD).

6. The apparatus of claim 1, wherein the image statistics collector is further to determine the image is new if it differs from a previous image by a threshold amount, and provide the statistics to the statistics processor when the image is determined to be new.

7. The apparatus of claim 1, wherein the statistics processor is further to determine when the reduced backlight brightness should be implemented in intervals; and determine phase-in backlight brightness levels and corresponding phase-in pixel enhancements.

8. The apparatus of claim 1, wherein the display interface is a wireless interface.

9. The apparatus of claim 1, wherein the display interface is a wired interface.

10. A computing device comprising a processor;

memory including a frame buffer to store content for presentation on an external display;

a display pipeline to retrieve pixels associated with frames to be written to the external display;

a display power savings device to receive the pixels, calculate and collect statistics related to the pixels and the frames including overall quality of the frames to be presented on the external display with a current backlight brightness of the external display, determine an amount the current backlight brightness for the external display can be reduced such that corresponding changes to the pixels can be made to approximate the overall quality of the frames to be presented on the external display based on the current backlight brightness of the external display;

generate backlight commands to instruct a backlight driver of the external display to provide a reduced backlight brightness that corresponds to reducing the current backlight brightness of the external display by the determined amount, and enhance the pixels with the corresponding changes; and a display output to provide interface processing and connection to the external display via a display interface that supports backlight control.

11. The computing device of claim 10, wherein the display interface is to transmit the enhanced pixels to the external display via data channels therewithin, and the backlight commands to the external display via control channels therewithin.

12. The computing device of claim 10, wherein the display power savings device is to consider at least some subset of external display parameters, computing device policies, and user preferences when determining the reduced backlight brightness and corresponding pixel changes.

13. The computing device of claim 10, wherein the display interface is a wireless interface.

14. The computing device of claim 10, wherein the display interface is a wired interface.

15. The computing device of claim 10, wherein the display power savings is further to determine if the frames are new if they differ from a previous frame by a threshold amount prior to calculating and collecting statistics and only performs the calculating and collecting for new frames.

16. The computing device of claim 10, wherein the display power savings is further to determine when the reduced backlight brightness for the external display should be implemented in intervals; and determine phase-in backlight brightness levels for the external display and corresponding phase-in pixel enhancements.

17. A system comprising a computing device to generate content;

an external display to present the content; and a wired display interface to connect the computing device and the external display;

wherein the computing device includes display power savings functionality to receive pixels for frames destined for the external display, calculate and collect statistics related to the pixels and the frames including overall quality of the frames to be presented on the external display with a current backlight brightness of the external display, determine an amount the current backlight brightness for the external display can be reduced such that corresponding changes to the pixels can be made to approximate the overall quality of the frames to be presented on the external display based on the current backlight brightness of the external display, generate backlight commands to instruct a backlight driver of the external display to provide a reduced backlight brightness that corresponds to reducing the current backlight brightness of the external by the determined amount, and enhance the pixels with the corresponding changes; and wherein the external display adjusts its backlight brightness based on the backlight commands.

18. The system of claim 17, wherein the display power savings functionality is to consider at least some subset of parameters of the external display, policies of the computing device, and user preferences when determining the reduced backlight brightness and corresponding pixel changes.

19. The system of claim 17, wherein the wired display interface includes a video graphics array (VGA) interface cable.

20. The system of claim 17, wherein the display power savings is further to determine if the frames are new if they differ from a previous frame by a threshold amount prior to calculating and collecting statistics and only performs the calculating and collecting for new frames.

21. The system of claim 17, wherein the display power savings is further to determine when the reduced backlight brightness for the external display should be implemented in intervals; and determine phase-in backlight brightness levels for the external display and corresponding phase-in pixel enhancements.

* * * * *